US010859273B2

(12) United States Patent
Cukjati et al.

(10) Patent No.: US 10,859,273 B2
(45) Date of Patent: Dec. 8, 2020

(54) ROTISSERIE OVEN WITH IMPROVED TRAP SYSTEM

(71) Applicant: Alto-Shaam, Inc., Menomonee Falls, WI (US)

(72) Inventors: Deborah Cukjati, West Allis, WI (US); Thomas Stollenwerk, Mayville, WI (US); Nicholas DeMarais, Menomonee Falls, WI (US); Jeremy Buford, Horicon, WI (US); Leslie Klump, Oconomowoc, WI (US); Joshua Didur, Brown Deer, WI (US); Joseph Kulakowski, Hartford, WI (US); Thomas Whalen, Darien, WI (US); Andy Tischendorf, Cambellsport, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 342 days.

(21) Appl. No.: 15/889,647

(22) Filed: Feb. 6, 2018

(65) Prior Publication Data

US 2018/0224129 A1 Aug. 9, 2018

Related U.S. Application Data

(60) Provisional application No. 62/455,891, filed on Feb. 7, 2017.

(51) Int. Cl.
*F24C 14/00* (2006.01)
*F24C 15/16* (2006.01)
(Continued)

(52) U.S. Cl.
CPC ..... *F24C 14/005* (2013.01); *B01F 1/00* (2013.01); *B08B 3/024* (2013.01); *B08B 3/08* (2013.01);
(Continued)

(58) Field of Classification Search
CPC ..... F24C 14/00; F24C 15/02; F24C 15/16; B08B 9/08; B08B 9/032
See application file for complete search history.

(56) References Cited

U.S. PATENT DOCUMENTS 3,989,891 A * 11/1976 Freestone ..... H04N 5/10 348/605
5,451,744 A * 9/1995 Koopman ..... A47J 37/042 219/400
5,499,577 A * 3/1996 Tommasini ..... F24C 14/005 126/21 A
(Continued)

FOREIGN PATENT DOCUMENTS

WO 2004094912 10/2004
WO 2015164239 10/2015

*Primary Examiner* — Edelmira Bosques
*Assistant Examiner* — Nikhil P Mashruwala
(74) *Attorney, Agent, or Firm* — Boyle Fredrickson S.C.

(57) ABSTRACT

A grease and food particle trap for use with an oven shooter tube cleaning system that provides improved resistance to clogging and improved maintenance better matching the ability of the shooter tube cleaning system to provide complete cleaning and removal of grease and food particles is provided. An auxiliary heating system may provide improved energy efficiency and temperature control for cleaning operation by separately heating the cleaning solution upstream from the shooter tube prior to delivering a cleaning spray to the cooking volume.

16 Claims, 8 Drawing Sheets

(51) Int. Cl.

| | |
|---|---|
| ***B08B 3/02*** | (2006.01) |
| ***B08B 3/08*** | (2006.01) |
| ***B08B 3/14*** | (2006.01) |
| ***B08B 17/02*** | (2006.01) |
| ***B08B 9/00*** | (2006.01) |
| ***B08B 9/093*** | (2006.01) |
| ***B01F 1/00*** | (2006.01) |

(52) U.S. Cl.

CPC ..... *B08B 3/14* (2013.01); *B08B 9/093* (2013.01); *F24C 15/164* (2013.01); *B08B 3/02* (2013.01); *B08B 9/00* (2013.01); *B08B 17/025* (2013.01); *B08B 2203/007* (2013.01); *B08B 2209/08* (2013.01)

(56) References Cited

U.S. PATENT DOCUMENTS 6,405,738 B1 * 6/2002 Clark ..... A47J 37/12 134/115 R
6,626,190 B2 * 9/2003 Durth ..... F24C 14/005 126/20
6,772,751 B2 * 8/2004 Deuringer ..... F24C 14/005 126/20
7,556,034 B2 * 7/2009 De Miranda Grieco ..... F24C 14/005 126/211
7,677,239 B2 * 3/2010 De Miranda Grieco ..... F24C 14/005 126/211
8,151,697 B2 * 4/2012 Valentine ..... A47J 37/042 99/421 H
8,375,848 B2 * 2/2013 Valentine ..... A47J 37/042 99/421 H
9,464,814 B2 * 10/2016 Hangmann ..... F04B 23/04
9,599,347 B2 * 3/2017 Furlanetto ..... A21B 3/006
9,895,721 B2 * 2/2018 Menominee ..... B08B 3/02
9,964,311 B2 * 5/2018 Behle ..... B08B 9/08
10,473,336 B2 * 11/2019 Livchak ..... B01D 53/72
10,589,325 B2 * 3/2020 Helm ..... B05B 3/066
2005/0022676 A1 * 2/2005 Swank ..... A21B 3/02 99/419
2006/0223357 A1 * 10/2006 Ohki ..... H01R 13/6595 439/362
2006/0260476 A1 * 11/2006 Helm ..... F24C 14/005 99/476
2007/0102418 A1 * 5/2007 Swank ..... F24C 15/02 219/400
2008/0223357 A1 * 9/2008 Bartelick ..... B08B 9/00 126/21 A
2013/0133638 A1 5/2013 Kulakowski et al.
2013/0199511 A1 * 8/2013 Laessig ..... F24C 7/085 126/369
2015/0059807 A1 3/2015 Behle et al.
2019/0195509 A1 * 6/2019 Blommaert ..... F24C 14/005

* cited by examiner

ROTISSERIE OVEN WITH IMPROVED TRAP SYSTEM

CROSS-REFERENCE TO RELATED APPLICATIONS

This application claims the benefit of U.S. provisional application No. 62/455,891, filed Feb. 7, 2017, and hereby incorporated by reference.

BACKGROUND OF THE INVENTION

The present invention relates generally to cooking implements, and in particular relates to a cleaning system for rotisserie ovens.

Rotisserie ovens are traditionally used to cook raw meat and poultry product, such as chicken, duck, and the like, inside a cooking chamber. In particular, a food product to be prepared is carried by a rotating spit assembly that brings the food product into communication with a radiating heat source that cooks, and in some cases, browns the outer surface of the food product.

Some food product, when cooked, produces significant quantities of grease which may be allowed to drain away from the food and to be captured in a drip pan positioned at the bottom of the oven. The drip pan may be attached to a drain line to allow gravity draining of the grease into a removable collection container. One method of providing such a drainage system is described in U.S. Pat. No. 7,421,942 entitled "Grease Collection System for Oven," the disclosure of which is hereby incorporated by reference. For ovens using steam to cook food, the grease may drip into a water-filled condenser chamber and subsequently be pumped out of the chamber for disposal. This method is described in U.S. Pat. No. 8,997,731 entitled "Grease Handling Apparatus for Closed System Oven," the disclosure of which is hereby incorporated by reference.

U.S. application Ser. No. 14/926,502 entitled Rotisserie Oven With Shooter Tube Cleaning System, filed by the assignee of the present invention and hereby incorporated by reference, describes a cleaning system for a rotisserie oven using a high-pressured shooter tube which allows the cleaning solution to be shot from the reservoir to the top walls of the oven cavity without the need for additional tubing.

SUMMARY OF THE INVENTION

The present invention provides a trap for use with the above cleaning system that provides improved resistance to clogging and improved maintenance better matching the ability of the shooter tube system to provide complete cleaning and removal of grease and food particles.

In one embodiment of the present invention, an oven may be provided having an oven housing defining a cooking volume and having a door providing access to a cooking volume and sealing the cooking volume when the door is in a closed position; an oven heater communicating with the cooking volume to heat the same; a cleaning assembly including a reservoir chamber communicating with the cooking volume through a drain opening in a floor of the oven volume, a pump communicating through a first opening in the reservoir to pump a cleaning solution out of the reservoir and expel the cleaning solution to the cooking volume through a nozzle directing a spray against the interior of the cooking volume, and a cleaning heater assembly communicating with the cleaning solution to heat the same.

It is thus a feature of at least one embodiment of the invention to use a dedicated heater for heating cleaning fluid for improved heat efficiency.

The cleaning heater assembly may include a heater contained in a chamber and where the pump receives water from the reservoir and pumps it through the chamber. The heater may be positioned at an outlet of the pump. The cleaning heater assembly may be upstream from the nozzle and downstream from the pump.

It is thus a feature of at least one embodiment of the invention to minimize temperature loss before water is sprayed and to spray the oven with the warmest temperature water.

The cleaning heater assembly may be positioned beneath the cooking volume.

It is thus a feature of at least one embodiment of the invention to allow leakage heat and leakage liquid to spill into the cooking cavity.

The heater may be an immersion heater providing an electrical heating element surrounded by a sheath electrically insulating the electrical heating element from surrounding liquid.

It is thus a feature of at least one embodiment of the invention to minimize heat loss by heating the water directly.

The cleaning heater assembly may be held within a heating chamber separated by a baffle preventing water from exiting the heating chamber before passing through the cleaning heater assembly.

It is thus a feature of at least one embodiment of the invention to pass all water over the heater for greatest heat efficiency.

The oven may further include a second opening in the reservoir chamber and permitting a movement of grease through the second opening and a third opening in the reservoir chamber permitting a movement of freshwater from a freshwater source through the third opening where the second opening and third opening are on adjacent sidewalls and the freshwater source is configured to spray freshwater orthogonal to the second opening. The freshwater source may be configured to spray freshwater along a curved path.

It is thus a feature of at least one embodiment of the invention to use pressurized water entering the reservoir to clear out ports and remove clogs.

The nozzle may be positioned proximate a center of the floor of the oven volume.

It is thus a feature of at least one embodiment of the invention to provide even distribution of cleaning liquid within the oven cooking cavity.

Another embodiment of the present invention may provide an oven having an oven housing defining a cooking volume and having a door providing access to a cooking volume and sealing the cooking volume when the door is in a closed position; an oven heater communicating with the cooking volume to heat the same; a cleaning assembly including a reservoir chamber communicating with the cooking volume through a drain opening in a floor of the oven volume, a pump communicating through a first opening in the reservoir to pump a cleaning solution out of the reservoir and expel the cleaning solution to the cooking volume through a nozzle, a cleaning heater assembly communicating with the cleaning solution to heat the same; and a filter extending over the drain opening in a first position and exposing the drain opening in a second position to permit user access to the reservoir chamber.

It is thus a feature of at least one embodiment of the invention to allow for easy access to the reservoir to allow a user to remove clogs and food debris.

The filter may be a basket slidably moveable along an upper wall of the reservoir chamber along rails between the first and second position. A bottom wall of the basket may be downwardly sloping. The basket may be perforated with holes sized to catch large debris.

The oven may further include a second filter separating the reservoir chamber into a first portion leading to the drain opening and a second portion communicating directly with a drain port. The second filter may slope generally upward from the bottom wall of the reservoir chamber at a point about midway along the length of the bottom wall, contacting left and right sidewalls and joining to an underside of an upper wall of the reservoir chamber close to an end side wall joining the left and right sidewalls. The second filter may be perforated with holes sized to catch large debris. The second filter may be an angled screen.

Another embodiment of the present invention may be a method of operating an oven, the method comprising the steps of: (a) providing an oven having: an oven housing defining a cooking volume and having a door providing access to a cooking volume and sealing the cooking volume when the door is in a closed position; a heater communicating with the cooking volume to heat the same; a cleaning assembly including a reservoir chamber communicating with the cooking volume through a drain opening in a floor of the oven volume, a pump communicating through a first opening in the reservoir to pump a cleaning solution out of the reservoir and expel the cleaning solution to the cooking volume through a nozzle, and a cleaning heater assembly communicating with the cleaning solution to heat the same, (b) introducing a cleaning agent into the reservoir to produce a cleaning solution; (c) activating the cleaning heater assembly to heat the cleaning solution; and (c) activating the pump to pump the cleaning solution from the reservoir through the nozzle.

These particular objects and advantages may apply to only some embodiments falling within the claims and thus do not define the scope of the invention.

DETAILED DESCRIPTION OF THE INVENTION

Figure 1:
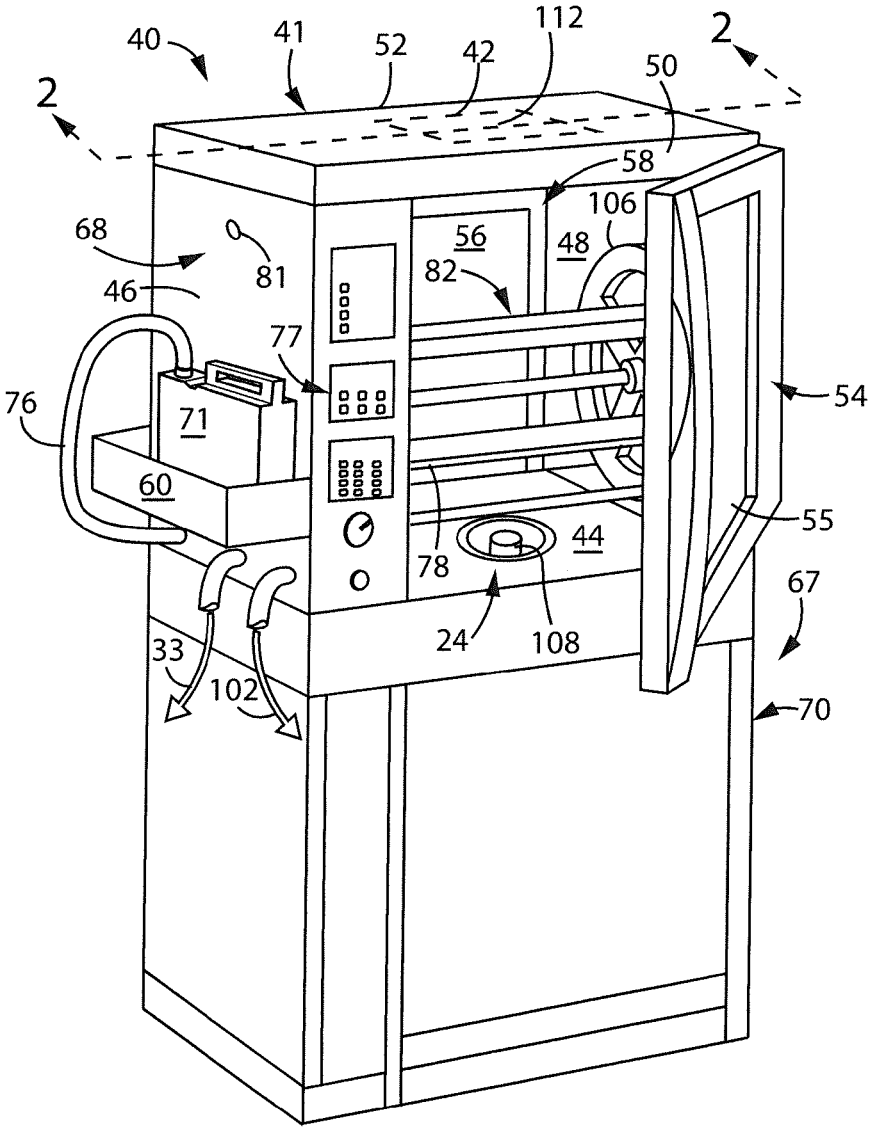
FIG. 1 is a perspective view of a rotisserie oven stacked on top of a warming chamber in accordance with the preferred embodiment.

Referring initially to FIG. 1, a rotisserie oven 40 includes an outer housing 41 having upper and lower walls 42 and 44, respectively, opposing left and right sidewalls 46 and 48, respectively, and opposing front and rear walls 50 and 52, respectively. A cooking chamber 58 is defined by upper and lower walls 42 and 44, right side wall 48, and a left chamber side wall 64 spaced inwardly from, and extending parallel to, oven sidewall 46.

Walls 64 and 46 thus define the lateral boundaries of a cabinet 68 that contains control components (e.g., a microprocessor or other suitable controller) of oven 40. In particular, cabinet 68 houses a control assembly 110 (see FIG. 3) that controls various aspects of the oven 40, such as cooking sequences, draining functions, and cleaning functions as is described in more detail below. Cabinet 68 further houses a motor 74 (see FIG. 4A) that drives a spit assembly 82. Oven operation is controlled by an operator via a set of user controls 77 including inputs and outputs that are disposed on the front wall 50 of cabinet 68. An indicator 81, such as a light or an audible alarm, can be disposed anywhere on the oven, including at the chef side or the server side, and can be activated either manually or automatically via controls 77 upon completion of a cooking sequence.

A front door assembly 54 is connected to the front wall 50, and a rear door assembly 56 is carried by the rear wall 52, that can both be opened and closed to provide access to cooking chamber 58. Front door assembly 54 includes a window assembly 55 that provides visible access to the cooking chamber 58. Rear door assembly 56 may be constructed in the manner described with respect to front door assembly 54. Oven 40 thus has a pass-through design as described in U.S. Pat. No. 6,608,288, the disclosure of which is hereby incorporated by reference, and thus may further be used in accordance with the methods described therein.

For instance, one such method of using an oven of the type having a heating cavity that utilizes cooking elements to produce a prepared food product from a raw food product, a chef-side access assembly including a first door for the insertion of raw food product into the cavity, and a server-side access assembly located remote from the chef-side access assembly and including a second door for the removal of prepared food product from the cavity, can include the step of first inserting raw food product into the cavity via the first door. Next, the cooking elements (preferably the rotisserie cooking elements, as are described in more detail below) are activated via controls 77. Next, indicator 81 is activated once the raw food product has been prepared. Finally, in response to indicator 81, the prepared food product can be removed from cooking chamber via the rear, server-side door 56.

The rotisserie oven 40 can be mounted on top of a warming chamber 67 including a housing 70 of generally the same size and shape as housing 41, and an internal warming chamber (not shown) of generally the same size and shape of cooking chamber 58. Advantageously, the rotisserie oven 40 and warming chamber 67 may be stacked on top of each other. Ovens 40 and warming chamber 72 are modular, such that oven 40 has rotisserie and/or convection heating components installed and warming chamber 72 may have a conductive heating systems installed that are configured to maintain the temperature of the food product that was prepared in the rotisserie oven. Oven 40 can alternatively be supported on, for instance, a kitchen floor directly via any suitable conventional a support assembly. For example, oven 40 can be supported by support legs with wheels for ease of maneuvering or with support feet for stabilized positioning.

Figure 4A:
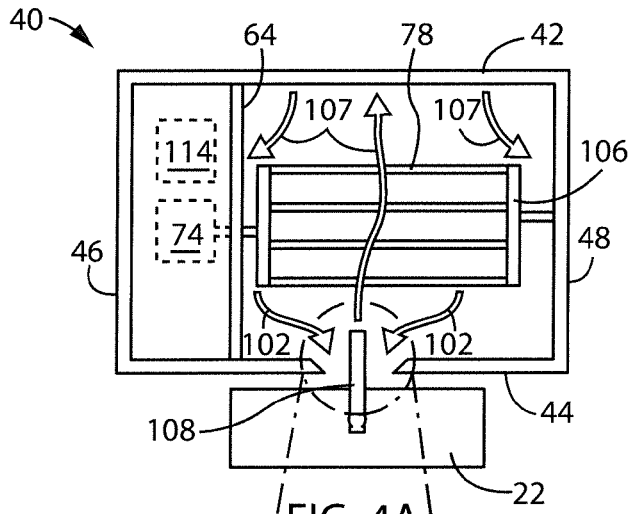
FIGS. 4A and 4B is a cross-section similar to FIG. 2 showing the oven cavity and an enlarged cross-sectional perspective view of the shooter tube and reservoir opening.

Referring in addition to FIG. 4A, spit assembly 82 includes a plurality of spits (collectively identified as 78) that span between sidewalls 46 and 48 of the cooking chamber 58. Specifically, spits 78 span between a pair of support disks 106 (one shown in FIG. 1) and are suitable for retaining meat product such as chicken, turkey, duck, and the like. Disks 106 are rotated under power supplied by motor 74 to correspondingly rotate the meat product with respect to a heat source or sources. The cooking chamber 58 incorporates a convection heating system 114 that is used to cook raw food product along with a radiant heat system 112 that browns the food being prepared.

A recess is formed in left chamber sidewall 64 that carries a convection heating system 114 that includes a standard resistive coil in the form of a loop that is connected to controls 77 and produces heat in response to an electrical current input. A fan is disposed inside the loop formed by the coil, and includes a circular plate supporting a plurality of circumferential fan blades that rotate about a hub to draw air into heating system 114 from cooking chamber 58. The air is also expelled radially outwardly by the fan blades, thereby forcing the air to flow across the resistive coil before being expelled into the cooking chamber 58 to heat the food product.

Oven 40 further includes a radiant heat system 112 that delivers radiating heat to food product carried by spit assembly 82. Radiant heat system 112 may be centrally disposed above spit assembly 82 at upper wall 42. Radiant heat system 112 includes a plurality of rectangular ceramic disks having grooves that at least partially enclose traditional resistive coils. In particular, the bottom of the coil (when positioned as installed in the cooking chamber 58) is essentially coated with a ceramic material which has been found to emit infrared heat that is less scattered compared to coils that are not embedded in ceramic. The food product is thus browned more uniformly than conventionally achieved. The coils are connected via electrical leads to the control, and emit heat upon an electrical current input. Accordingly, heat is produced in response to the supply of electrical power to the coils, which is controlled via user controls 77, in order to prepare food product rotating with spit assembly 82.

The outer housing 41 of oven 40 may provide a shelf 60 attached to the outer surface of the oven side wall 46 for supporting a container for retaining, for example, a concentrated cleaning solution to be pumped into the oven 40, as will be further described below.

A controller board 110 within the housing 41 may provide an electronic computer or microcontroller receiving instructions from controls 77 accessible on the front of the oven 40, and having, for example membrane switches that may be activated by the user. As will be discussed in greater detail below, the controller board 110 generally provides an electronic computer executing a stored program 118 to control, for example, the radiant heat system 112, convection heating system 114, spit motor 74, and cleaning assembly 116, to be described further below, turning them on and off as necessary to implement a particular cooking schedule or cleaning schedule.

The rotisserie oven 40 may be as generally described in U.S. Pat. No. 7,487,716, the disclosure of which is hereby incorporated by reference and further adapted as provided in the disclosure provided herein.

Figure 2:
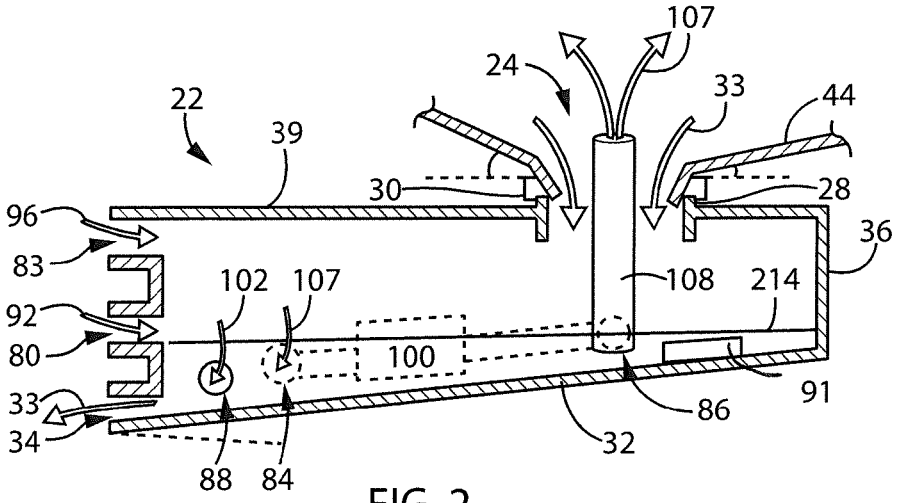
FIG. 2 is a fragmentary cross-section along line 2-2 of FIG. 1 showing a first embodiment of the grease management system of the present invention providing for the collection of grease and cleaning solution through a common drain opening.

Referring now to FIGS. 1 and 2, a cleaning assembly 116 of oven 40 provides a reservoir chamber 22 positioned with respect to a lower wall 44 of the cooking chamber 58 so that a drain aperture 24 of lower wall 44 is located directly above a drainpipe 28 of the reservoir chamber 22, the latter being a short tube extending vertically upward to the drain aperture 24 when the reservoir chamber 22 is positioned beneath the lower wall 44. The drainpipe 28 allows grease and grease 33 passing through the drain aperture 24 to enter the reservoir chamber 22 under the influence of gravity. The lower wall 44 may be inclined toward the drain aperture 24 to facilitate the drainage of grease and grease 33 through the drain aperture 24.

Figure 3:
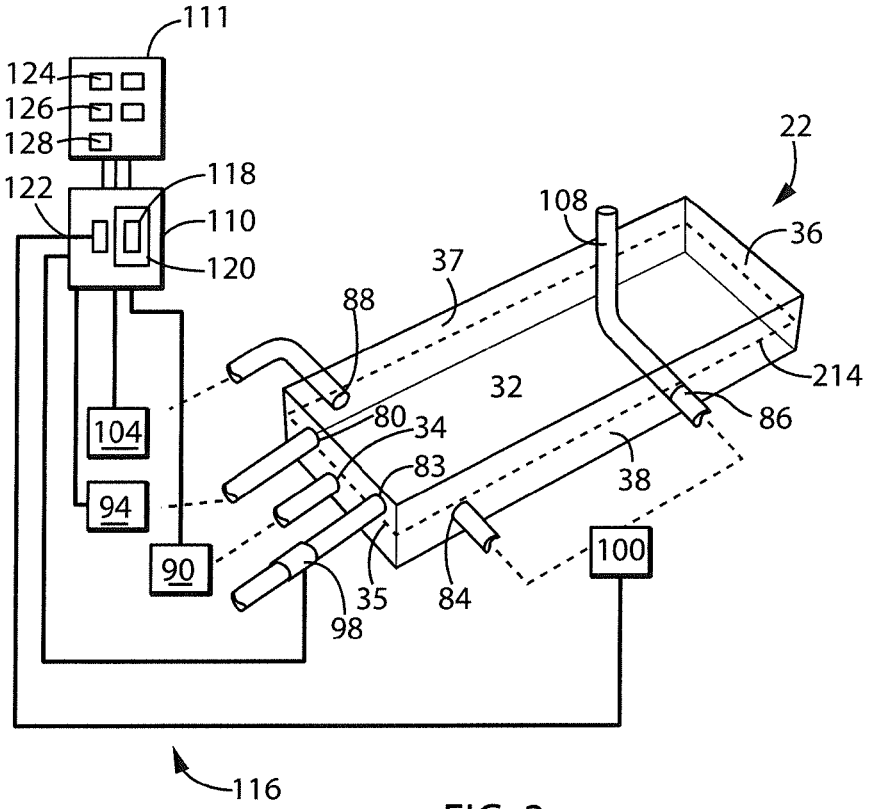
FIG. 3 is an orthographic view of the grease management system showing connection to other oven elements including a computer controller board and various pump elements.

Referring now to FIGS. 2 and 3, the reservoir chamber 22 provides a generally enclosed box having a bottom wall 32 sloping downwardly from an end closest to the drainpipe 28 to an opposite end adjacent to a grease discharge port 34. In an alternative configuration (not shown), the bottom wall 32 is generally horizontal. Upstanding sidewalls 35, 36, 37, 38 around the periphery of the bottom wall 32 retain accumulated grease and cleaning solution within the reservoir chamber 22 as will be described further below. Left sidewall 35 opposite right sidewall 36 define a left and right end, respectively, with respect to the oven 40, and are connected at their front and rear edges by sidewalls 37, 38 defining a front and rear end, respectively, with respect to the oven 40. These upstanding sidewalls 35, 36, 37, 38 are joined at their upper edges to a generally horizontal upper wall 39 adjacent to a bottom of the reservoir chamber 22. The upper wall 39 carries the drainpipe 28 which aligns with the drain aperture 24 of the lower wall 44. The lower end of the drainpipe 28 extends below the upper wall 39 and above the water level 26. In an alternative embodiment (not shown), the drainpipe 28 extends upward but stops at the upper wall 39 so that it does not extend below the upper wall 39.

Figure 4B:
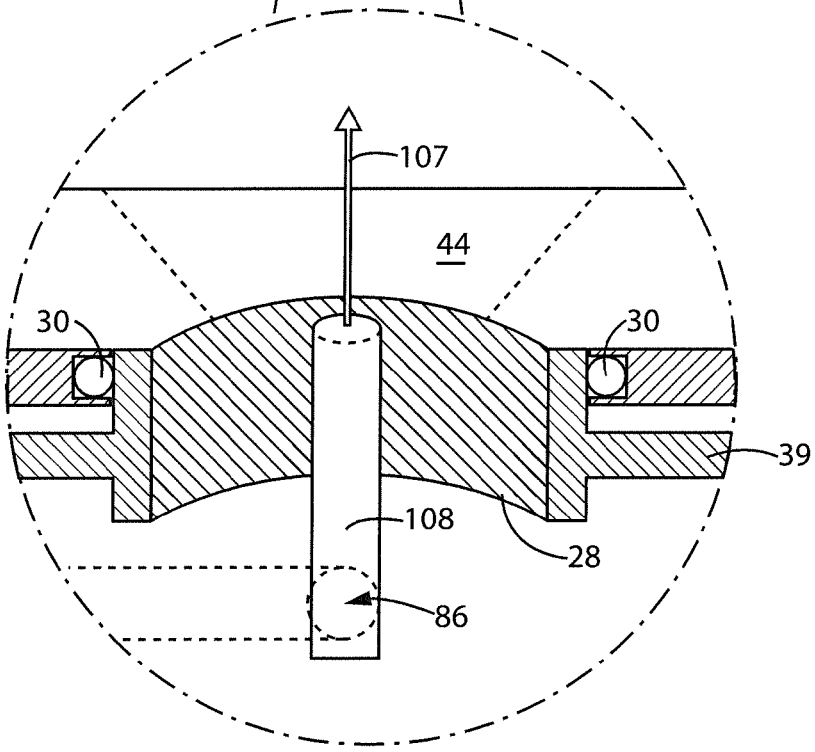

Referring also to FIGS. 4A and 4B, a shooter tube 108 extends horizontally into the reservoir chamber 22 from the front sidewall 38 toward the rear sidewall 37, ending generally mid-way between the front and rear sidewalls 37 and 38, and closer to the right sidewall 36 than the left sidewall 35. The shooter tube 108 is generally centered below the drainpipe 28 and drain aperture 24 to further extend vertically upward through the drainpipe 28. The shooter tube 108 may be generally concentric with the drainpipe 28 opening. The shooter tube 108 extends slightly above the drainpipe 28 to reside within the drain aperture 24. However, it is possible for the shooter tube 108 to extend through and reside above the drain aperture 24 or within or below the drainpipe 28.

The diameter of the drain aperture 24 and drainpipe 28 opening are generally similar, with the diameter of the drainpipe 80 opening at least as large as the drain aperture 24 to prevent leakage. The drain aperture 24 may be facilitated by a downwardly and inwardly inclined lip which helps to funnel the fluid to the drainpipe 28. An O-ring 30 or gasket may be positioned between a lip of the drain aperture 24 and the drainpipe 28 to create a seal at the interface therebetween. In an alternative embodiment, the interface may be a welded joint instead of utilizing the O-ring 30.

The shooter tube 108 generally has a diameter less than the diameter of the drain aperture 24, and generally less than half the diameter of the drain aperture 24 and drainpipe 28 to provide sufficient clearance around the shooter tube 108. The clearance allows for the flow of fluids, such as grease, oil, and wastewater through the drainpipe 28 around the shooter tube 108. The clearance also allows for the insertion of cleaning tablets into the reservoir chamber 22, to be further described below.

Referring again to FIGS. 2 and 3, left sidewall 35 provides a grease discharge port 34, a liquid cleaner inlet drainpipe 80, and a freshwater inlet port 83. The grease discharge port 34 provides for a flow of grease and grease 33 out of the reservoir chamber 22 through a conduit passing to and facilitated by a grease discharge pump 90 or suction pump. The grease discharge port 34 is generally arranged close to the bottom wall 32 to collect grease and grease 33 from a bottom of the reservoir chamber 22. The liquid cleaner inlet drainpipe 80 provides for flow of concentrated liquid cleaner 92 into the reservoir chamber 22 through a conduit passing from a pump 94. Freshwater inlet port 83 provides for a flow of freshwater 96 from a freshwater source through a conduit and into the reservoir chamber 22 and may be controlled by a valve 98. Liquid cleaner inlet drainpipe 80 and freshwater inlet port 83 are generally centered between the bottom wall 32 and upper wall 39, or close to the upper wall 39 to be above a water level 214, to be further described below.

Front sidewall 38 provides cleaning solution outlet port 84 and shooter tube port 86. The cleaning solution outlet port 84 allows for the flow of cleaning solution 107 out of the reservoir chamber 22 through a conduit passing to and facilitated by a pump 100. The pump 100 proceeds to pump the cleaning solution 107 through a conduit to the shooter tube port 86 and into the shooter tube 108 extending within the reservoir chamber 22. The cleaning solution outlet port 84 is generally arranged close to the bottom wall 32 to collect cleaning solution from a bottom of the reservoir chamber 22.

Rear sidewall 37 provides waste drain port 88. Drain port 88 allows for a flow of wastewater 102 out of the reservoir chamber 22 through a conduit passing to and facilitated by a suction pump 104. The drain port 88 is generally arranged close to the bottom wall 32 to drain wastewater 102 from a bottom of the reservoir chamber 22.

It is understood that the location of the ports may be changed to any sidewall 35, 36, 37, 38, 39, and 44 of the reservoir chamber 22 and to any position on the sidewall. It is also understood that a pump or valve described above may be interchanged, or may be substituted by other known mechanisms for moving or controlling the flow of fluids, as understood in the art. It should be appreciated that the valve may be an automatic valve that is electrically connected to the oven circuitry and may be programmed to open and close according to the cooking or cleaning program, or opened and closed by the user via controls. Alternatively, the valve can be a manually actuated valve that is opened and closed using a knob or like handle that extends out from the valve.

Figure 5:
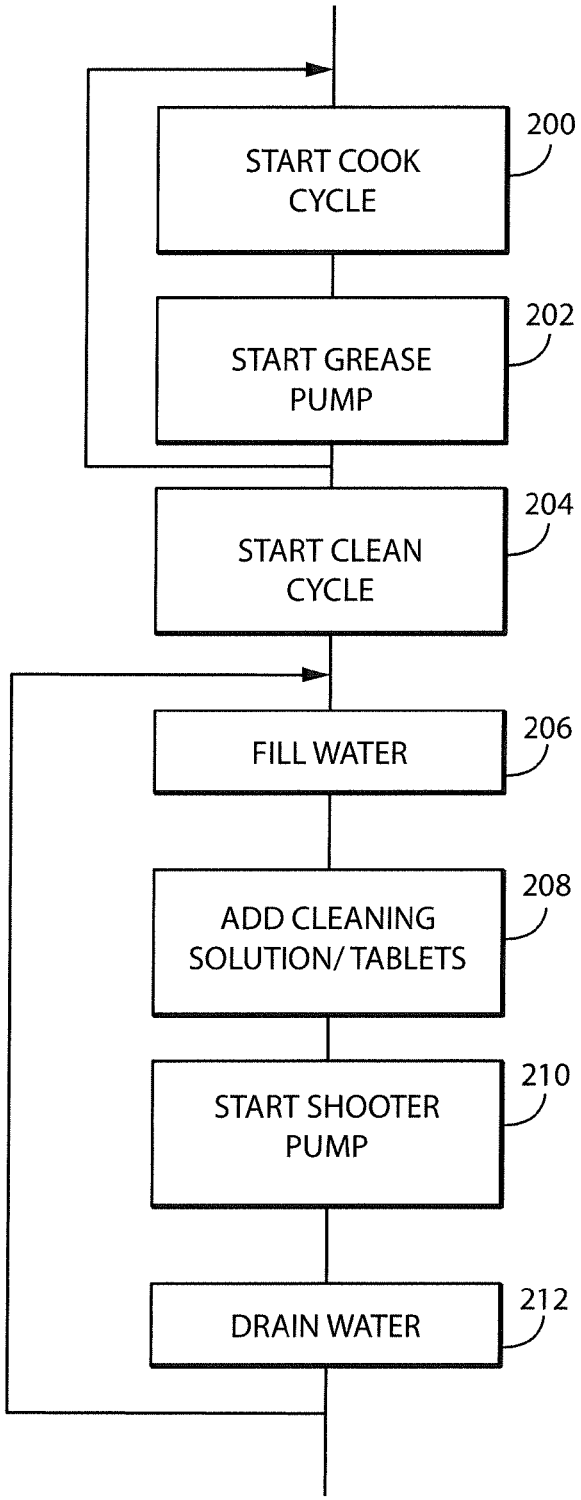
FIG. 5 is a simplified flowchart of the program executed by the controller board of FIG. 3 for managing grease and cleaning cycles.

Referring now to FIGS. 3 and 5, a controller board 110 may execute a stored program 118 held in a memory 120 using a processor 122 communicating with memory 120. The program 118 may selectively operate the grease discharge pump 90 both on a periodic basis during the cooking of foods that express grease and only in cooking modes associated with foods that express grease in order to conserve energy. The program 118 implements this functionality by communicating with a cooking program also executed by the controller board 110 and the control panel 111. The cooking program generally includes and implements prestored schedules of cooking times and temperatures for different foods. The cooking program may also allow manual setting of temperatures and times.

The program 118 also implements a cleaning program associated with the operation of the cleaning assembly 116. The program 118 may selectively operate the valve 98 during the cleaning program to fill the reservoir chamber with a predetermined volume of freshwater. The program 118 may also selectively operate the liquid cleaner pump 94 during the cleaning program to fill the reservoir chamber with concentrated liquid cleaner 92, for example, if cleaning tablets are not used. The program 118 may also selectively operate the pump 100 during the cleaning program to wash the oven 40 by pumping liquid cleaning solution 107 through the shooter tube 108 into the oven cavity. The program 118 may also selectively operate the suction pump 104 during the cleaning program to drain the wastewater 102 from the reservoir chamber 22 after washing.

The program 118 implements this functionality by communicating with a cleaning program (e.g., light clean, medium clean, heavy clean, forced rinse) also executed by the controller board 110 and the control panel 111. The cleaning program generally includes and implements prestored schedules of cleaning step duration, cleaning step order, and oven temperature, for different cleaning modes. The cleaning program may also allow manual setting of cleaning step duration, cleaning step order, and oven temperature.

Referring now to FIG. 5, a cooking cycle, as indicated by process block 200, may be initiated by indication of a particular cooking mode, captured by the cooking program 118 through cooking mode buttons 124 on control panel 111, such as may indicate, for example, a desired cooking schedule for cooking of chicken. In this regard, a particular button 124 may be labeled with indicia indicating roasted chicken, for example.

During the cooking cycle, a pump cycle, as indicated by process block 202, in which grease discharge pump 90 is turned on for a brief period of time or periodically may be initiated depending on the cooking program. Alternatively, the pump cycle 202 may be initiated by pressing of a special grease purge button 126 indicating a desire to manually operate the grease discharge pump 90.

During the cooking cycle 200, generally, grease will drop from the cooking food through the drainpipe 28 to be retained by the reservoir chamber 22. During process block 202, grease discharge pump 90 is activated to communicate with the reservoir chamber 22 to discharge accumulated grease 33 through the grease discharge port 34. The grease discharge pump 90 may pump the grease through a conduit of arbitrary length to a collection vessel, for example, removed from the oven 40 for convenient access. The removal path may include a conduit in the form of an inverted U-tube whereby the inverted-U extends higher than the upper wall 39 of the reservoir chamber to prevent excess grease from leaving the conduit if the reservoir chamber overflows. The "siphon" prevents the grease 33 from flowing back into the cooking chamber 58 and out of the inverted "U" since the grease 33 in the conduit cannot be higher than the water level at the source reservoir chamber 22. The grease discharge pump 90 may communicate with the controller board 110 to be controlled thereby according to the cooking program. Alternatively, a grease discharge valve may replace the grease discharge pump 90 and the inverted U-tube for controlling the flow of grease. The grease discharge valve may control the discharge of grease through the grease discharge port 34, and may be under the control of the controller board 110. The controller board 110 may communicate with the grease discharge valve to allow the movement of grease out of the reservoir chamber 22, as provided by the cooking program 118.

When the cooking cycle 200 is ended, a cleaning cycle, as indicated by process block 204, may be initiated by indication that a stored value, such as time since last cleaning or number of cooking cycles since last cleaning, meets a predetermined level. For example, the amount of time elapsed or number of cooking cycles since last cleaning is compared to a stored cleaning schedule providing a value representing a desired frequency of cleaning. If the stored value meets the predetermined level, the program 118 proceeds to process block 204. Alternatively, the cleaning cycle 204 may be initiated by pressing a special clean cycle button 128 indicating a desire to manually activate the cleaning cycle 204. The user may select a desired cleaning mode, for example, heavy, medium or light cleaning, or quick rinse cycle. If the cleaning cycle 204 is not initiated, the program 118 may be allowed to loop back to process block 200 to allow a subsequent cooking cycle 200. During the cleaning cycle 204, the grease discharge pump 90 is turned off. The grease discharge pump 90 is allowed to operate during the cooking cycle 200.

During the cleaning cycle 204, the reservoir chamber 22 is filled with freshwater 96, as indicated by process block 206, passing through the freshwater inlet port 83 of the left sidewall 35. A valve 98 may control the delivery of freshwater 96 through the freshwater inlet port 83 to the reservoir chamber 22, and may be under the control of the controller board 110. The controller board 110 may communicate with the valve 98 to deliver a predetermined volume of freshwater 96 into the reservoir chamber 22, as provided by the cleaning program. The controller board 110 may also communicate with a water level sensor (not shown) so that additional water is added through valve 98 when water is below a water level 214. At desired water level 214, the reservoir chamber 22 is filled with, for example, approximately 1 gallon of fluid, and the reservoir chamber 22 is generally filled halfway or below halfway. The desired water level 214 may be above the cleaning solution outlet port 84 and drain port 88, and below the freshwater inlet port 83 and liquid cleaner drainpipe 80. However, it is contemplated that the water level 214 may also be at or above the level of the freshwater inlet port 83 and liquid cleaner drainpipe 80. Alternatively, a freshwater pump may replace valve 98. The freshwater pump may control the movement of water through the freshwater inlet port 83, and may be under the control of the controller board 110. The controller board 110 may communicate with the freshwater pump to pump the freshwater into of the reservoir chamber 22, as provided by the cleaning program.

As indicated by process block 208, a cleaning agent is added to the reservoir chamber 22. When cleaning tablets 91 are used, a desired number of cleaning tablets 91, for example, one to four cleaning tablets, are placed into the reservoir chamber 22 through the drainpipe 28 opening where the tablets 91 are dropped into the freshwater 96 of the reservoir chamber 22 and are gradually dissolved in the freshwater 96 to produce a cleaning solution 107. For example, the tablets 91 may last for a desired number of cleaning cycles so that freshwater added at the beginning of each cleaning cycle will continue to produce a cleaning solution 107.

Alternatively, the reservoir chamber 22 may be filled with a concentrated liquid cleaner 92 that is mixed with the freshwater 96 of the reservoir chamber 22 to produce a cleaning solution 107. The concentrated liquid cleaner 92 passes through a liquid cleaner inlet drainpipe 80 of the left sidewall 35 into the reservoir chamber 22. The liquid cleaner pump 94 may pump the concentrated liquid cleaner 92 through a conduit 76 of arbitrary length from a solution container 71, for example, stored on an external shelf 60 for convenient access (see FIG. 1), to the liquid cleaner drainpipe 80 of reservoir chamber 22. The liquid cleaner pump 94 may communicate with the controller board 110 to be controlled thereby. The controller board 110 may communicate with the liquid cleaner pump 94 to deliver a predetermined amount of concentrated liquid cleaner 92 into the reservoir chamber 22, as provided in the cleaning program. The concentrated liquid cleaner 92 may be pumped into the reservoir chamber 22 at the beginning of each cleaning cycle sequence, for example, after or about the same time that the freshwater 96 is added. Alternatively, a liquid cleaner valve may replace liquid cleaner pump 94. The liquid cleaner valve may control the movement of liquid cleaner through the liquid cleaner inlet drainpipe 80, and may be under the control of the controller board 110. The controller board 110 may communicate with the liquid cleaner valve to permit the movement of liquid cleaner into the reservoir chamber 22, as provided in the cleaning program.

Once the reservoir chamber 22 is filled with cleaning solution 107, either through cleaning tablets 91 or concentrated liquid cleaner 92, the cleaning cycle proceeds to process block 210, whereby the pump 100 delivers cleaning solution 107 to the shooter tube 108. The pump 100 communicates with the controller board 110 to be controlled thereby. The pump 100 discharges the cleaning solution 107 out through the cleaning solution outlet port 84 to the pump 100. The pump 100 then delivers the cleaning solution 107 back through the shooter tube port 86 of the reservoir chamber 22 to the shooter tube 108. The controller board 110 may communicate with the pump 100 to deliver cleaning solution 107 to the shooter tube 108 for a predetermined duration or for a predetermined volume of cleaning solution 107, as provided by the cleaning program. Alternatively, the pump 100 will continue to cycle the cleaning solution 107 from the reservoir chamber 22 to the shooter tube 108 until the oven meets a desired visual cleanliness, and whereby the user may manually end the washing step 210.

During washing, the shooter tube 108 discharges the cleaning solution at a high-pressure force and volumetric rate, for example, between 5-10 gallons per minute and preferably at least 7 gallons per minute, allowing the cleaning solution 107 to contact the upper wall 42 of the cooking chamber 58. The cleaning solution 107 ricochets off the upper wall 42 to contact and clean the sidewalls 64 and 48. The spit motor 74 may be activated to rotate spit assembly 82, facilitating the deflection and dispersal of the cleaning solution 107 onto the sidewalls of the cooking chamber 58, and to clean the spit assembly 82 itself. Generally, the wastewater 109 will drip from the oven 40 walls and spit assembly 82, and fall into the drainpipe 28 to be retained by reservoir chamber 22.

Next, a draining step, as indicated by process block 210, will activate the suction pump 104 to discharge the wastewater 102 through the waste drain port 88 and out to a sanitary sewer line. For example, the waste drain port 88 may discharge onto a floor drain or the like. The removal path may include a conduit in the form of an inverted U-shape whereby the inverted "U" extends higher than the upper wall 39 of the reservoir chamber to prevent excess wastewater from leaving the conduit were the reservoir chamber to overflow. The "siphon" prevents the wastewater 102 from flowing back into the cooking chamber 58 and out of the inverted "U" since the wastewater 102 in the conduit cannot be higher than the water level at the source reservoir chamber 22. The suction pump 104 may communicate with the controller board 110 to be controlled thereby. Alternatively, a wastewater discharge valve may replace the suction pump 104 and the inverted U-tube. The wastewater discharge valve may control the discharge of wastewater through the waste drain port 88, and may be under the control of the controller board 110. The controller board 110 may communicate with the wastewater discharge valve to permit the movement of wastewater out of the reservoir chamber 22, as provided by the cleaning program.

The program 118 may loop back to process block 206 to continue cleaning until a set number of cleaning cycles is complete, a predetermined time has elapsed (for example 1-3 hours) or the oven has met predetermined visual cleanliness. Alternatively, the cleaning cycle 204 may end by pressing the clean cycle button 128 indicating a desire to manually end the cleaning cycle 204. After the cleaning cycle 204 is ended, the program 118 may loop back to allow for a new cooking cycle 200 to be initiated.

In an exemplary cleaning cycle 204, the process blocks 206 (water fill), 208 (cleaning agent fill-omitted if using cleaning tablets), 210 (wash) and 212 (drain) are run through consecutively, for example, two to three times, in order to remove grease 33 from the oven 40. To perform a more thorough clean, the duration of step 210 (wash) may be extended to provide a longer wash. Next, the process blocks 206 (water fill), 208 (cleaning agent fill), and 210 (wash) are performed at the same time, followed by step 210 (wash) and step 212 (drain) consecutively to perform a rinse cycle. In this respect, the cleaning solution may be re-circulated for an additional rinse before it is drained. The rinse cycle is run through consecutively, for example, three to four times, in order to fully rinse the oven 40 and the reservoir chamber 22.

It is contemplated that any schedule of process blocks 206 (water fill), 208 (cleaning agent fill-omitted if using cleaning tablets), 210 (wash) and 212 (drain) may be used in a cleaning schedule, and any duration of steps or order of steps may be performed. For example, steps may be performed simultaneously or sequentially, and repeated in any order, as desired by the cooking schedule.

Figure 6:
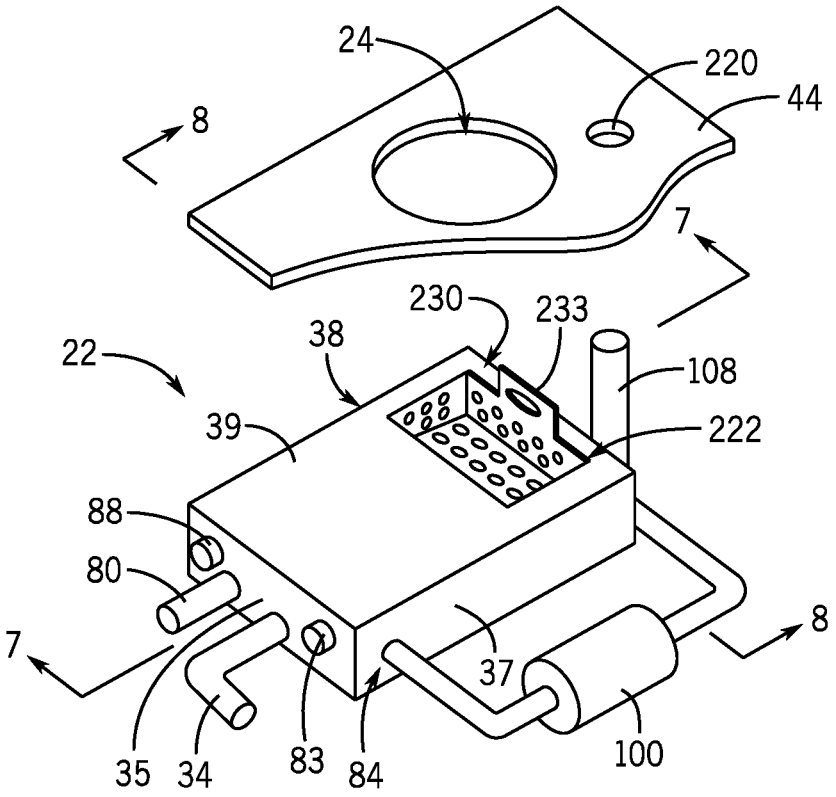
FIG. 6 is a an exploded perspective view of an alternative embodiment of the shooter tube and reservoir system with the shooter tube displaced to a side of the drain opening providing improved accessibility through the drain opening.

Referring now to FIG. 6, in an alternative embodiment, the shooter tube 108 may be displaced to one side of the chamber 22 to pass through its own opening 220 in the lower wall 44 of the oven adjacent to the opening of the drain aperture 24.

Figure 7:
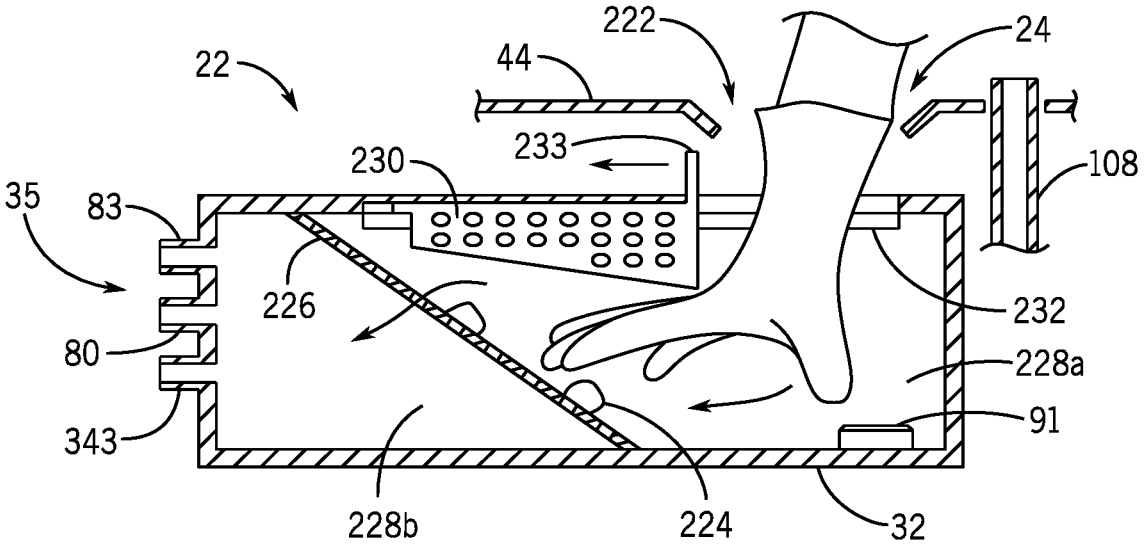
FIG. 7 is a cross-sectional view taken along line 7-7 of FIG. 6 showing a primary filter in a retracted position for cleaning of a secondary filter assembly.

Referring also to FIG. 7, this displacement of the shooter tube 108 opens up the drain aperture 24 so that an operator's hand may be easily inserted through the drain aperture 24 into the chamber 22 through an opening 222 in the upper wall 39 of the chamber 22. In this way, the operator may remove large debris 224 that may be trapped in a secondary filter 226 within the chamber 22 without the need for service call.

The secondary filter 226 separates the chamber 22 into a first portion 228*a* leading directly from the opening 222 and a second portion 228*b* communicating directly with the drain port 88, the liquid cleaner drainpipe 80, the grease discharge port 34 and the freshwater inlet port 83 as well as the solution outlet port 84. The secondary filter 226 may slope generally upward from the bottom wall 32 of the chamber 22 at a point about midway along the length of the bottom wall 32, contacting the front and rear sidewalls 37 and 38 and joining to the underside of the upper wall 39 close to the left wall 35. Significantly, the surface of the secondary filter 226 facing portion 228*a* is readily cleaned by hand through the opening 222. The secondary filter 226 may have elongated slots directed generally along a path of fluid flow along the length of the chamber 22 having a width of approximately ⅛ inch to one half inch and preferably one quarter inch.

Figure 8:
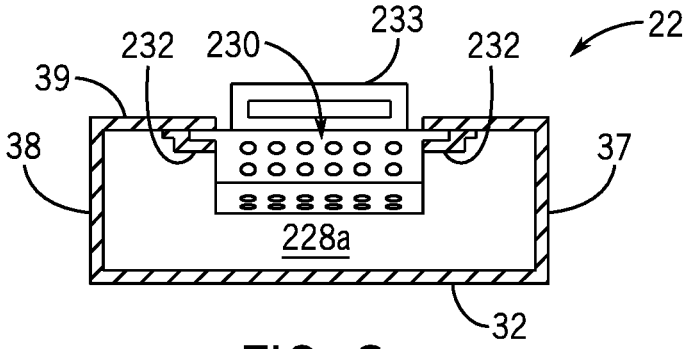
FIG. 8 is a cross-sectional view taken along lines 8-8 of FIG. 6 showing the support of the primary filter for slidable displacement along rails.
Figure 9:
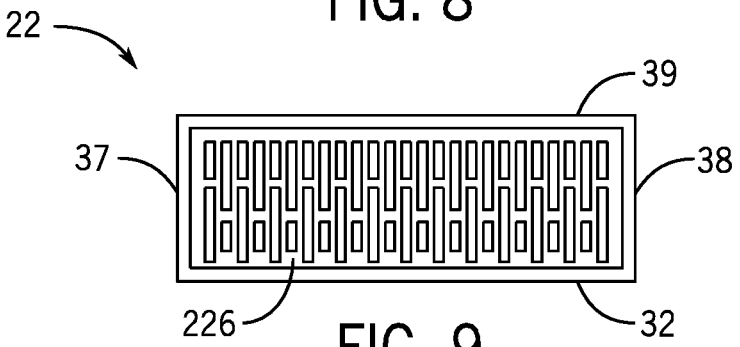
FIG. 9 is a cross-sectional view taken along line 8-8 of FIG. 6 but in the opposite direction as shown in FIG. 8 showing a secondary filter.

Referring also to FIGS. 8-9, a primary filter 230 in the form of an upwardly open basket may slidably move along the underside of upper wall 29 on rails 232 to be positioned at one extreme of its movement to fit beneath the opening 222 to receive all debris flowing into the opening 222 (as shown in FIG. 6) or to be slid away from the opening 222 to allow access by the operator's hand into the portion 228*a*.

A bottom wall of the basket of the primary filter 230 may slope downwardly in a direction away from portion 228*b* and the basket of the primary filter 230 may be perforated with numerous holes of diameter ⅛ to ½ inch (and preferably substantially one quarter inch) on all of its walls to catch large debris that would otherwise not fit through the liquid cleaner drainpipe 80, the drain port 88, or grease discharge port 34 and therefore might cause clogs. A handle 233 may be provided on the basket of the primary filter 230 extending upward from one wall of the basket of the primary filter 230 to assist in the sliding operation.

When the primary filter 230 is positioned beneath the opening 222, its interior also may be readily cleaned by hand through drain aperture 24. Grease, water, and debris passing through drain aperture 24 are first received within the basket formed by primary filter 230 and then pass into portion 228*a* through secondary filter 226 to be discharged as discussed above.

In other respects the reservoir may operate as discussed above with respect to FIGS. 1-5.

Figure 10:
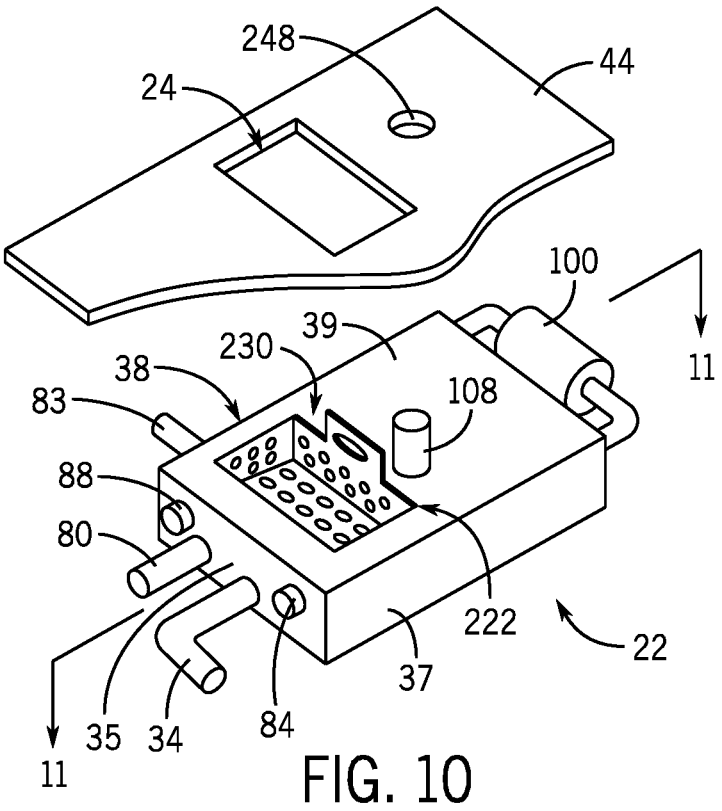
FIG. 10 is a an exploded perspective view of an alternative embodiment of the shooter tube and reservoir system with the shooter tube positioned in the center of the oven floor.

Referring now to FIG. 10, in an alternative embodiment, the shooter tube 108 may be substantially centered within the reservoir chamber 22 to pass through its own opening 248 in the lower wall 44 of the oven adjacent to the opening of the drain aperture 24. Similar to the embodiment shown in FIGS. 6-9, the operator's hand may be easily inserted through the drain aperture 24 into the chamber 22 through the opening 222 in the upper wall 39 of the chamber 22 to remove large debris.

Figure 11:
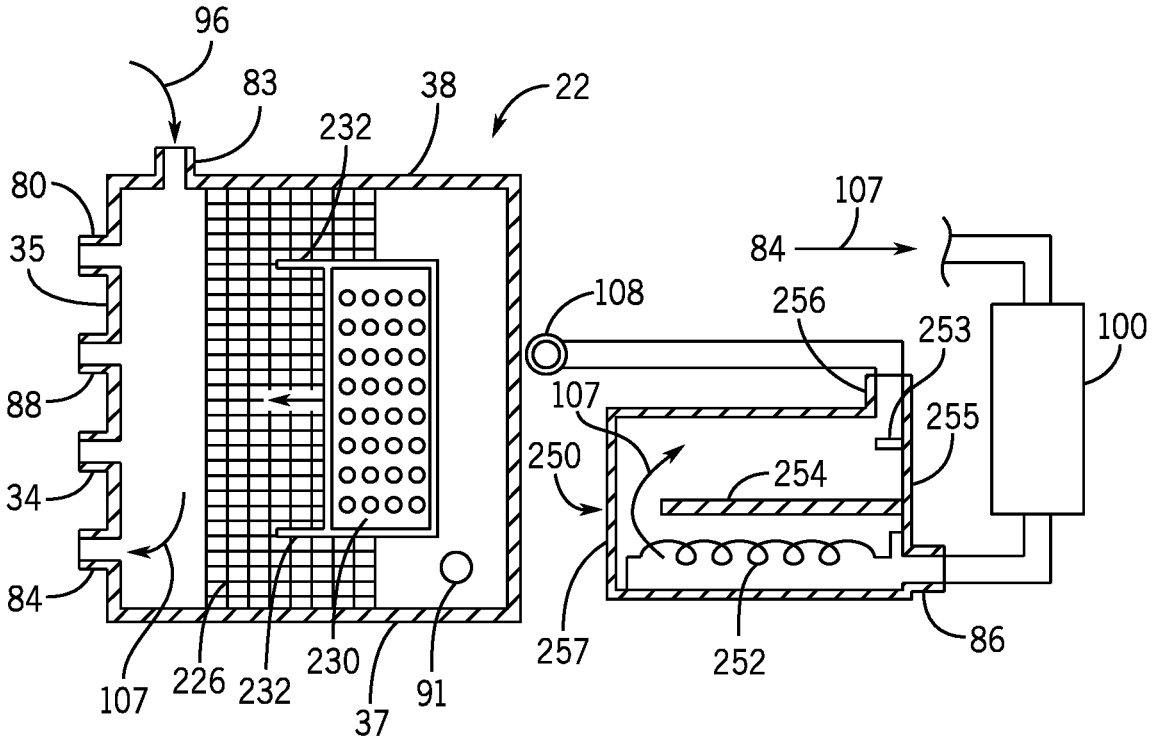
FIG. 11 is a cross-sectional view taken along lines 11-11 of FIG. 10 showing a dedicated heating chamber for heating the cleaning liquid.

Referring also to FIG. 11, the freshwater inlet port 83 may be held on a sidewall 37 and/or 38, adjacent to the left wall 35 holding the liquid cleaner drainpipe 80, the drain port 88, grease discharge port 34, and cleaning solution outlet port 84 so that freshwater 96 entering the chamber 22 shoots out past the liquid cleaner drainpipe 80, the drain port 88, grease discharge port 34, and cleaning solution outlet port 84. In this manner, the position of the freshwater inlet port 83 may be in close proximity to the left wall 35 such that pressurized freshwater 96 flowing through the freshwater inlet port 83 and in a "sweeping" fashion along a curve or multiple angles between 0 degrees and 180 degrees may assist with cleaning out the ports 80, 88, 34, 84 of the chamber 22 and removing clogs caused by debris such as large food particles, sediment, and viscous fluids.

A heating tank 250 is positioned adjacent the chamber 22 upstream from the shooter tube 108 and carrying an electrical heating element such as an immersion heater 252, separate from the radiant heat system 112 for heating or cooking food within the warming chamber 72 or other cooking heater of the oven, for heating up the cleaning solution 107 during cleaning operation. The immersion heater 252 is operated separately from the radiant heat system 112 or cooking heater of the oven for dedicated heating during cleaning operation. The immersion heater 252 may be an electrical heating element surrounded by a sheath electrically insulating the electrical heating element from surrounding liquid.

The pump 100 may receive the cleaning solution 107, for example formed by tablets 91 dropped into the freshwater 96, from the reservoir chamber 22 through the cleaning solution outlet port 84. The pump 100 then delivers the cleaning solution 107 into the heating tank 250 through the port 86 of the heating tank 250. A filter may be positioned upstream from the pump 100 to prevent debris from entering the pump 100 and to prevent clogs.

The cleaning solution 107 passes through the heating tank 250 with direct contact with the immersion heater 252 for directly heating the cleaning solution 107. The heated cleaning solution 107 is directed to pass through the immersion heater 252 by a baffle 254 separating the chamber 22 into a first portion holding the port 86 and immersion heater 252 and a second portion holding an outlet 256, but allowing the cleaning solution 107 to pass from the first portion to the second portion. The baffle 254 may contact the floor and ceiling of the chamber 22, and extend from a wall 255 of the port 86 toward an opposite wall 257 but providing a gap between the baffle 254 and the opposite wall 257 to allow cleaning solution 107 to pass from the first portion to the second portion. The cleaning solution 207 may pass along a U-shaped path through the immersion heater 252, around the baffle 254, and out of the heating tank 250 through the outlet 256 communicating with the shooter tube 108. The heated cleaning solution 107 is then delivered through the shooter tube 108 for cleaning with wastewater reentering the chamber 22 through drain aperture 24 as part of a closed loop was system.

In other respects the reservoir may operate as discussed above with respect to FIGS. 1-5 or with respect to the embodiment shown in FIGS. 6-9.

Figure 12:
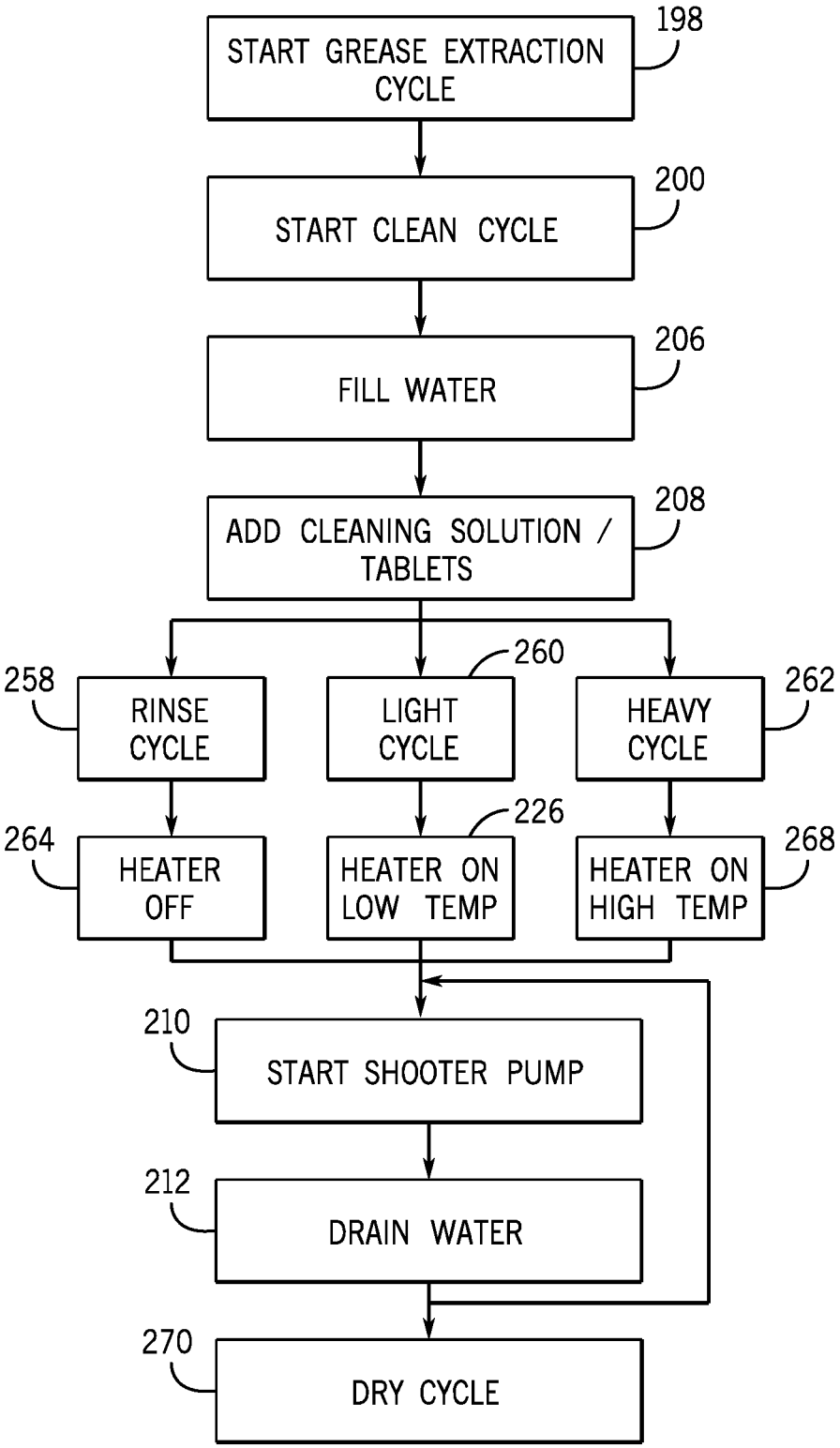
FIG. 12 is a simplified flowchart of the program for rinse, light and heavy cleaning cycles.

Referring to FIG. 12, and as described above, the controller board 110 may execute the stored program 118 held in the memory 120 using the processor 122 communicating with memory 120 (see FIG. 3). The program 118 may selectively operate the immersion heater 252 during the cleaning program 118 according to signals from a thermostat 253 to heat the cleaning solution 107 within the heating tank 250. The thermostat 253 may be positioned within the heating tank 250 or downstream from the heating tank 250 to detect a temperature signal and communicate with the controller board 110 to adjust the operation of the immersion heater 252.

In one embodiment, a grease extraction cycle 198 may occur after cooking but before the cleaning cycles according to stored program 118. During the grease extraction cycle 198, freshwater may be introduced into the reservoir chamber 22 at a specified time after cooking operation ends for a specified duration. The grease extraction cycle 198 is provided to create a siphon of flowing fluid in order to remove grease from the chamber 22 while the fluid is still inviscid.

Following the grease extraction cycle 198, the cleaning cycles may be operated according to stored program 118 including a user selected rinse cycle 258, light clean cycle 260, and heavy clean cycle 262. The rinse cycle 258 may circulate cleaning solution 107 without turning on the immersion heater 252, and optionally adding a lime descaler to the cleaning solution 107, as indicated by process block 264. The light clean cycle 260 may circulate cleaning solution 107 at a lower temperature, for example, less than 170° F., as indicated by process block 266, while the heavy clean cycle may circulate cleaning solution 107 at a higher temperature, for example, at or above 170° F., as indicated by process block 268. The temperature of the cleaning solution 107 may be determined by a temperature sensor (not shown) so that the immersion heater 252 remains in an ON state when a higher temperature is desired or turned to an OFF state when the desired temperature is achieved or a lower temperature is desired. The heavy clean cycle 262 may also incorporate additional cycles of cleaning or longer duration of cleaning compared to the light clean cycle 260.

The cleaning cycles may end with a dry cycle 270, which prevents the user from opening the front door assembly 54 or rear door assembly 56 until the warming chamber 72 of the oven is dry. Once the cleaning cycle is ended, the user may operate the oven 40 immediately without additional drying time.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a controller" and "a processor" should be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. An oven comprising:

an oven housing defining a cooking volume and having a door providing access to a cooking volume and sealing the cooking volume when the door is in a closed position;

an oven heater communicating with the cooking volume to heat the same; and a cleaning assembly including a reservoir chamber communicating with the cooking volume through a drain opening in a floor of the oven volume, a pump communicating through a first opening in the reservoir to pump a cleaning solution out of the reservoir and expel the cleaning solution to the cooking volume through a nozzle directing a spray against an interior of the cooking volume, a cleaning heater assembly communicating with the cleaning solution to heat the same, and further comprising a second opening in the reservoir chamber permitting a movement of grease through the second opening and a third opening in the reservoir chamber permitting a movement of freshwater from a freshwater source through the third opening wherein the second opening and third opening are on adjacent sidewalls and the freshwater source is configured to spray freshwater orthogonal to the second opening.

2. The oven of claim 1 wherein the cleaning heater assembly is positioned beneath the cooking volume.

3. The oven of claim 1 wherein the cleaning heater assembly includes a heater contained in a tank and wherein the pump receives water from the reservoir and pumps it through the tank.

4. The oven of claim 3 wherein the heater is positioned at an outlet of the pump.

5. The oven of claim 3 wherein the heater is an immersion heater providing an electrical heating element surrounded by a sheath electrically insulating the electrical heating element from surrounding liquid.

6. The oven of claim 1 wherein the cleaning heater assembly is held within a tank separated by a baffle preventing water from exiting the tank prior to passing through the cleaning heater assembly.

7. The oven of claim 1 wherein freshwater source is configured to spray freshwater along a curved path.

8. The oven of claim 1 wherein the nozzle is positioned proximate a center of the floor of the oven volume.

9. The oven of claim 1 wherein the cleaning heater assembly is upstream from the nozzle and downstream from the pump.

10. An oven comprising:

an oven housing defining a cooking volume and having a door providing access to a cooking volume and sealing the cooking volume when the door is in a closed position;

an oven heater communicating with the cooking volume to heat the same; and a cleaning assembly including a reservoir chamber communicating with the cooking volume through a drain opening in a floor of the oven volume, a pump communicating through a first opening in the reservoir to pump a cleaning solution out of the reservoir and expel the cleaning solution to the cooking volume through a nozzle directing a spray against an interior of the cooking volume, a cleaning heater assembly communicating with the cleaning solution to heat the same, a first filter extending over the drain opening in a first position and exposing the drain opening in a second position to permit user access to the reservoir chamber, and a second filter separating the reservoir chamber into a first portion leading to the drain opening and a second portion communicating directly with a drain port, wherein the second filter slopes generally upward from a bottom wall of the reservoir chamber at a point about midway along a length of the bottom wall, contacting left and right sidewalls and joining to an underside of an upper wall of the reservoir chamber close to an end side wall joining the left and right sidewalls.

11. The oven of claim 10 wherein the first filter is a basket slidably moveable along an upper wall of the reservoir chamber along rails between the first and second position.

12. The oven of claim 11 wherein a bottom wall of the basket is downwardly sloping.

13. The oven of claim 12 wherein the basket is perforated with holes sized to catch large debris.

14. The oven of claim 10 wherein the second filter is perforated with holes sized to catch large debris.

15. The oven of claim 14 wherein the second filter is an angled planar screen.

16. A method of operating an oven, the method comprising the steps of:

(a) providing an oven having:

an oven housing defining a cooking volume and having a door providing access to a cooking volume and sealing the cooking volume when the door is in a closed position;

a heater communicating with the cooking volume to heat the same;

a cleaning assembly including a reservoir chamber communicating with the cooking volume through a drain opening in a floor of the oven volume, a pump communicating through a first opening in the reservoir to pump a cleaning solution out of the reservoir and expel the cleaning solution to the cooking volume through a nozzle directing a spray against an interior of the cooking volume, and a cleaning heater assembly communicating with the cleaning solution to heat the same, and further comprising a second opening in the reservoir chamber permitting a movement of grease through the second opening and a third opening in the reservoir chamber permitting a movement of freshwater from a freshwater source through the third opening wherein the second opening and third opening are on adjacent sidewalls and the freshwater source is configured to spray freshwater orthogonal to the second opening;

(b) introducing a cleaning agent into the reservoir to produce a cleaning solution;

(c) activating the cleaning heater assembly to heat the cleaning solution; and (c) activating the pump to pump the cleaning solution from the reservoir through the nozzle.

* * * * *